US008333163B2

(12) United States Patent
Major

(10) Patent No.: US 8,333,163 B2
(45) Date of Patent: Dec. 18, 2012

(54) MOORING SYSTEM FOR A CONVENTIONAL TANKER

(75) Inventor: Fredrik Major, Arendal (NO)

(73) Assignee: Sevan Marine ASA, Arendal (NO)

( * ) Notice: Subject to any disclaimer, the term of this patent is extended or adjusted under 35 U.S.C. 154(b) by 344 days.

(21) Appl. No.: 12/444,654

(22) PCT Filed: Oct. 16, 2007

(86) PCT No.: PCT/NO2007/000361

§ 371 (c)(1),
(2), (4) Date: Jul. 1, 2009

(87) PCT Pub. No.: WO2008/082306

PCT Pub. Date: Jul. 10, 2008

(65) Prior Publication Data

US 2010/0024704 A1 Feb. 4, 2010

(30) Foreign Application Priority Data

Oct. 17, 2006 (NO) ..... 20064700

(51) Int. Cl.
*B63B 21/50* (2006.01)
*B63B 21/22* (2006.01)

(52) U.S. Cl. ..... 114/293; 114/230.22

(58) Field of Classification Search ..... 114/230.2, 114/265, 266, 230.23, 230.22, 293, 230.1; 441/3, 23

See application file for complete search history.

(56) References Cited

U.S. PATENT DOCUMENTS

| | | | | |
|---|---|---|---|---|
| 102,878 | A * | 5/1870 | Street | 4/487 |
| 3,552,343 | A | 1/1971 | Scott | |
| 4,067,280 | A * | 1/1978 | Serfess | 114/128 |
| 4,169,580 | A * | 10/1979 | Hatlapa et al. | 254/361 |
| 4,372,535 | A * | 2/1983 | Gibson et al. | 254/319 |
| 4,771,987 | A * | 9/1988 | Priest | 254/280 |
| 6,073,917 | A * | 6/2000 | Plummer | 254/389 |
| 6,463,870 | B2 * | 10/2002 | Beato et al. | 114/293 |
| 6,571,723 | B1 * | 6/2003 | Bech et al. | 114/230.2 |
| 6,983,712 | B2 * | 1/2006 | Cottrell et al. | 114/230.15 |
| 7,117,808 | B2 * | 10/2006 | Kulikov et al. | 114/230.1 |
| 2010/0218710 | A1 * | 9/2010 | Feger | 114/26 |

FOREIGN PATENT DOCUMENTS

WO WO 97/47516 A 12/1997

(Continued)

OTHER PUBLICATIONS

S9086-TW-STM-010/CH582R2 Naval Ship's Technical Manual: Chapter 582 Mooring and Towing, Dec. 1, 2001, Naval Sea Systems Command, Chapter 582 Rev 2.*

(Continued)

*Primary Examiner* — Lars A Olson
*Assistant Examiner* — Andrew Polay
(74) *Attorney, Agent, or Firm* — Frommer Lawrence & Haug LLP; Ronald R Santucci

(57) ABSTRACT

Mooring system for a tanker, i.e. a mooring of a conventional tanker to an installation with fixed orientation, wherein a conventional tanker (3) which is to be moored to the installation is arriving in a direction favorable to wind, current and waves. By mooring a conventional tanker (3) in four points (A, B, C, D) on a tanker (3), wherein the hawsers to the points (C, D) are connected on board a platform (1) and hawsers to the points (A, B) are connected to two separate buoys (4, 5) and then tightening/slackening the hawsers until the tanker (3) has arrived in the desired/correct position.

1 Claim, 4 Drawing Sheets

FOREIGN PATENT DOCUMENTS

| | | | |
|---|---|---|---|
| WO | WO 98/35874 | A | 8/1998 |
| WO | WO 01/10707 | A | 2/2001 |

OTHER PUBLICATIONS

Department of Defense, Unified Faclities Criteria, Design: Mooring, UFC 4-159-03, Oct. 3, 2005.*

Bluwater Marine, Conventional Buoy Mooring Systems (Marketing Materials).*

S9086-TW-STM-010/CH582R2 Naval Ship's Technical Manual: Chapter 582 Mooring and Towing by Naval Sea Systems Command.*

* cited by examiner

MOORING SYSTEM FOR A CONVENTIONAL TANKER

This is a 371 filing of International Patent Application No. PCT/NO2007/000361 filed Oct. 16, 2007 and published on Jul. 10, 2008 under publication number WO 2008/082306 A and claims priority benefits to Norwegian Patent Application Number 2006 4700 filed Oct. 17, 2006, the disclosure of which is hereby incorporated by reference.

The present invention relates to a mooring system for a tanker, i.e. mooring of a conventional tanker to an installation with fixed orientation, according to the preamble of the claims.

Mooring of a conventional tanker i.e. a tanker without dynamic positioning and bow loading equipment for load transfer to/from a fixed or floating platform with a fixed orientation, is traditionally done via a loading station. The loading station comprises a hawser which connects the tanker to the platform and where the transfer of load takes place through a hose leading from the platform to the mid-ship manifold of the tanker.

In order to keep the tanker in position, an auxiliary vessel is necessary to keep is the tanker away from the platform. An incorrect operation of the auxiliary vessel or line tear off has with this type of mooring led to collision between the tanker and the platform.

In case of changing wind and/or current conditions, this can lead to that a loading operation must be interrupted. An interrupted loading operation can easily lead to one or several days delay, which can be very costly for the owner of the tanker but also for supplier due to tight delivery conditions.

It is therefore an object of the present invention to provide a mooring system for conventional tankers, which on one side shall reduce the need for costly auxiliary vessels during the loading operation of the tanker and on the other side reduce the risk and the need for interruptions in the loading process. This is achieved with the mooring system according to the present invention as it is defined by the features of the appended claims.

Figure 1:
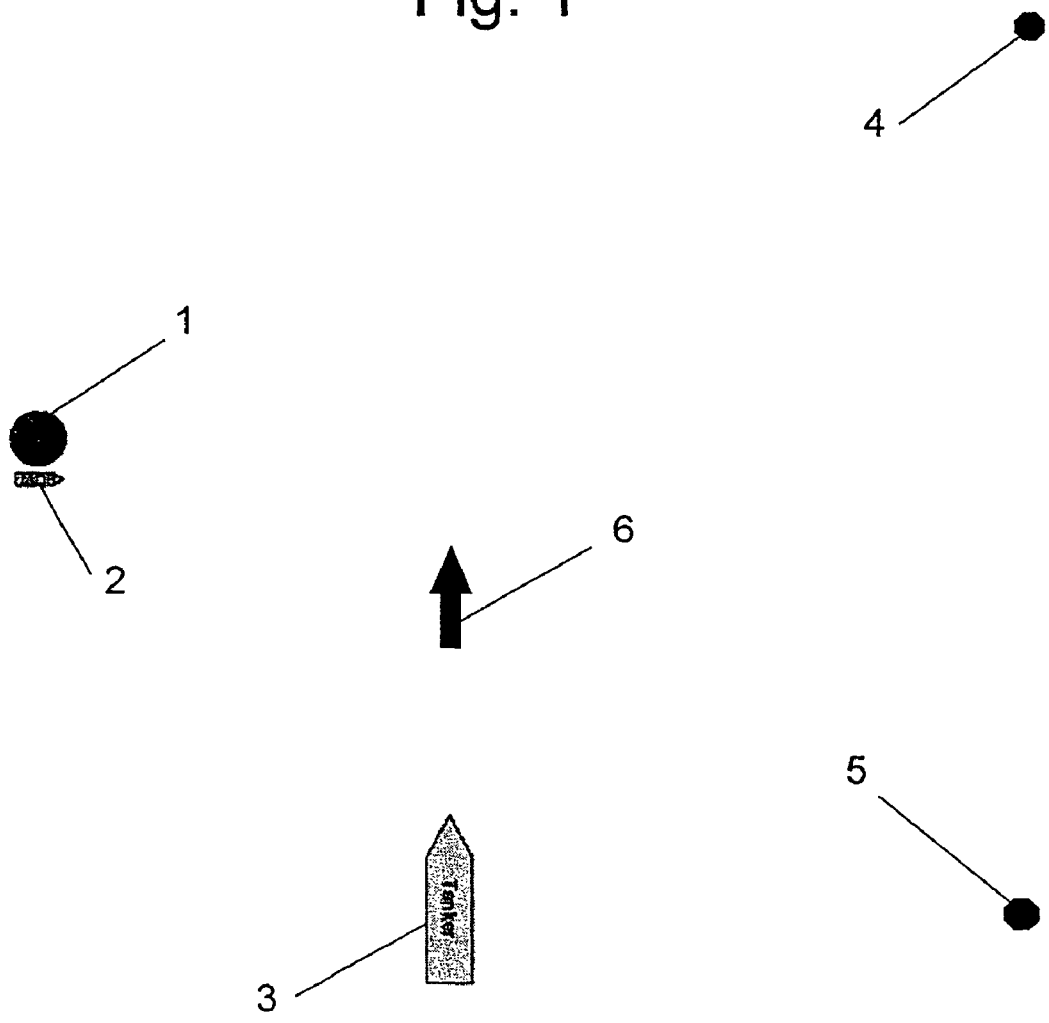
Figure 2:
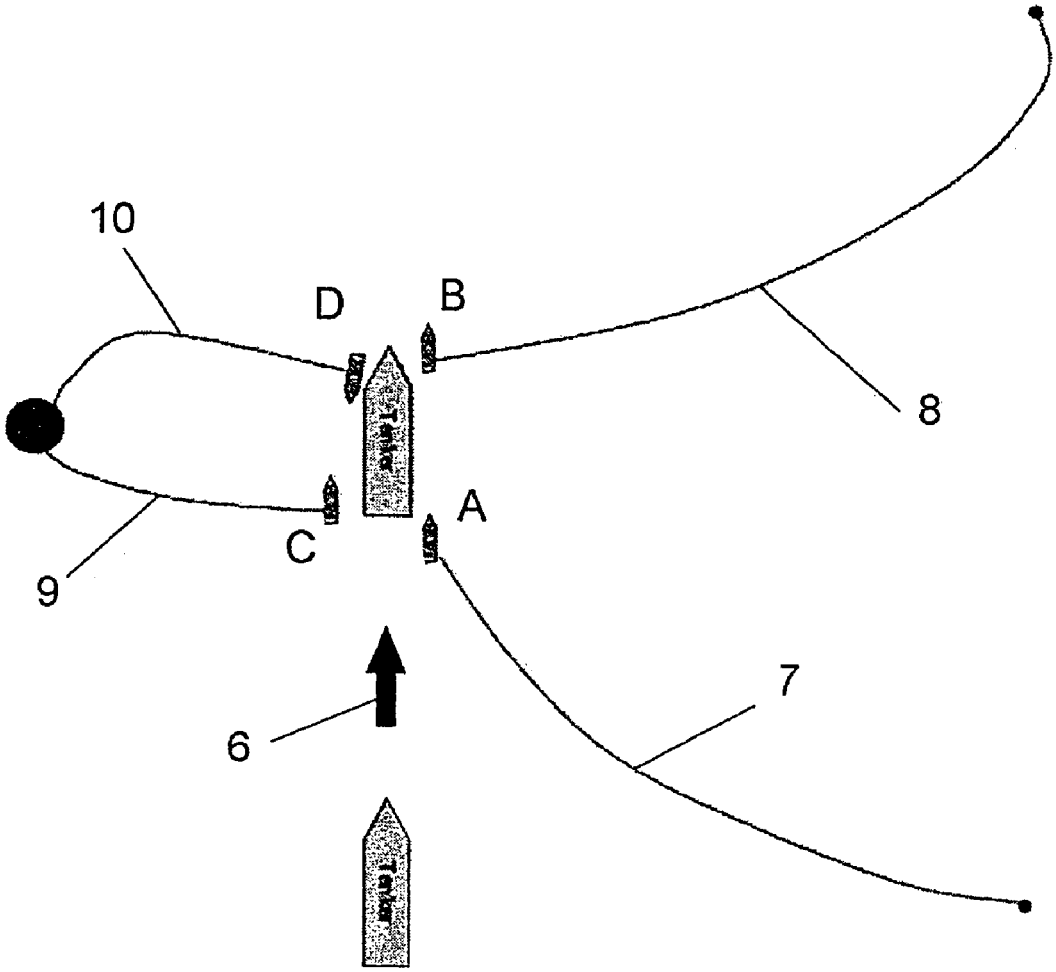
Figure 3:
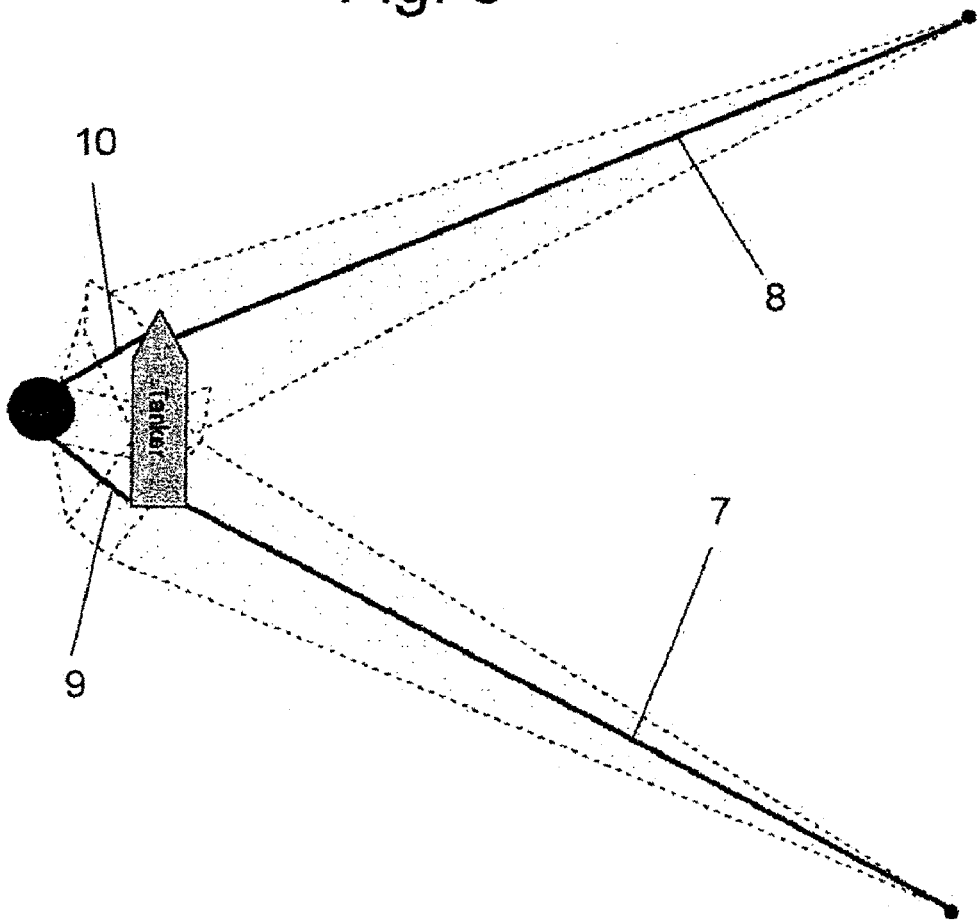
Figure 4:
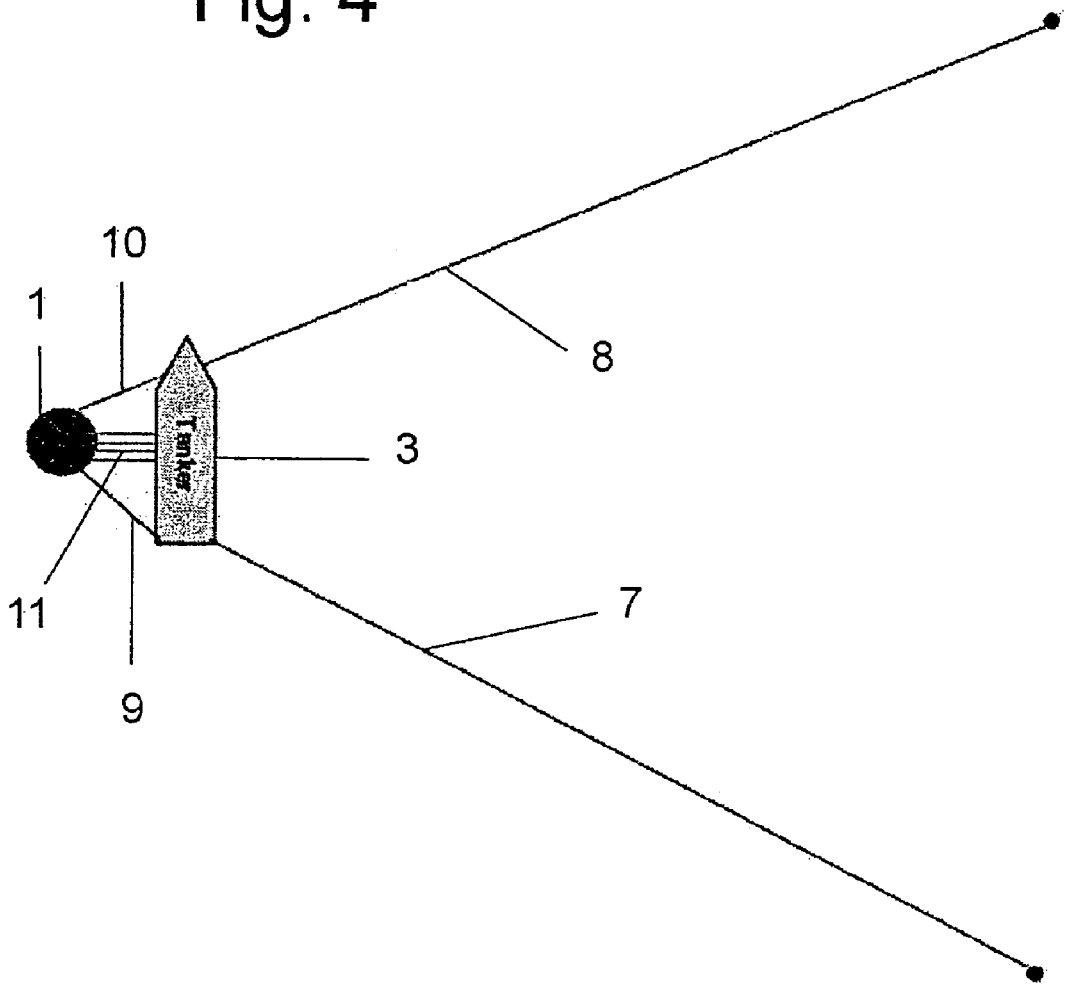

The present invention will be described further in connection with an embodiment and with reference to the drawings, in which FIG. 1 shows a tanker approaching the platform for load transfer, FIG. 2 shows how an auxiliary vessel from the platform helps out with the hawsers to the tanker, FIG. 3 shows how the tanker independently can turn according to wind and current by adjusting the hawsers, and FIG. 4 shows a conventional tanker ready moored to a platform and with load transfer hoses attached to the mid-ship manifold.

The mooring system according to the invention is based on mooring a conventional tanker 3 in four points A, B, C, D on the tanker 3, where the hawsers to the points C,D are connected on board a platform 1 and the hawsers to the points A,B are connected to two separate buoys 4, 5. Each buoy 4, 5 is anchored by means of a rope consisting of a wire, chain and/or polyester rope, down to at least one anchor on the seabed. The anchor can be at least one of the anchors used by the platform.

With reference to FIGS. 1 and 2, a conventional tanker 3 which is to be moored to a platform 1, is approaching. The tanker 3 arise in a direction which is favourable for wind, current and waves to a position between the nearest buoy 5 and the platform 1. On/by the platform 1 is an auxiliary vessel 2 which is to assist in the delivery of hawsers to the tanker 3. In the sailing direction 6 to the tanker 3 another buoy 4 is positioned, which also is to be used to moor the tanker 3.

The auxiliary vessel on the platform will now be subject to a routine as follows (ref FIG. 2):

1) The auxiliary vessel 2 has in turn arrived and fixed a hawser 7, with a fore-runner if necessary, to the buoy 5 nearest the arriving tanker 3 and thereafter provide the forerunner to someone on board the tanker. The tanker 3 will then lay down the line on the aft capstan A and take control of the hawser 7.
2) The auxiliary vessel 2 will then proceed to the next buoy 4 and connects a hawser 8, with a forerunner if necessary, to this buoy and thereafter provide the forerunner to someone on board the tanker. The tanker 3 will then lay down the line on the forward capstan B and take control over the hawser 8.
3) The auxiliary vessel 2 will then return to the platform 1 and fetch a hawser 9 with a forerunner if necessary, and thereafter provide the forerunner for the hawser to someone on board the tanker. The tanker 3 will then lay down the line on the aft capstan C and take control over the hawser 9.
4) The auxiliary vessel 2 will then once again return to the platform 1 and fetch another hawser 10, with a forerunner if necessary, and thereafter provide the forerunner to someone on board the tanker. The tanker 3 will then lay down the line on the forward capstan D and take control over the hawser 10.
5) The auxiliary vessel 2 then return to the platform 1.

During this procedure the tanker 3 will move in the sailing direction 6 until the hawsers 7, 8, 9, 10, which are connected aft and forward, are tightened in order to place the tanker 3 in the most favorable position to wind, current and waves.

In FIG. 3 it is shown how the tanker 3, on its own, can position itself by tightening or slackening the hawser 7, 8, 9, 10 to obtain a suitable distance to the platform and orientation with regards to the waves, wind and current as indicated by the dotted lines of the tanker and hawsers.

Referring to FIG. 4, the tanker 3 is shown ready moored in the four points in relation to the platform 1 and at least one loading hose 11 is transferred to the tanker 3 mid-ship manifold in order to start the loading.

The invention claimed is:

1. Method for mooring a conventional tanker between at least one buoy and an installation of fixed orientation, wherein an auxiliary vessel on the platform is subjected to the following steps:

1) the auxiliary vessel drives out and connects a hawser with a forerunner to the buoy nearest the arriving tanker and thereafter provide the forerunner to someone on board the tanker who will position this line on the aft capstan and take control over the hawser,
2) the auxiliary vessel drives to the next buoy and connects a hawser with a forerunner to this buoy and thereafter provide the forerunner to someone on board on the tanker who then position the line on the forward capstan and take control over the hawser,
3) the auxiliary vessel drives to the platform and collects a hawser with a forerunner providing the forerunner of the hawser to someone on board the tanker who then position the line on the aft capstan and take control over the hawser,
4) the auxiliary vessel will then once again return to the platform and fetch another hawser with a forerunner providing the forerunner to someone on board the tanker who will then lay down the line on the forward capstan and take control over the hawser,
5) the auxiliary vessel drives back to the platform.

* * * * *